US006606063B1

(12) United States Patent
Merenda

(10) Patent No.: US 6,606,063 B1
(45) Date of Patent: Aug. 12, 2003

(54) RADIATION SYNTHESIZER FEED CONFIGURATIONS

(75) Inventor: Joseph T. Merenda, Northport, NY (US)

(73) Assignee: BAE Systems Information and Electronic Systems Integration Inc., Greenlawn, NY (US)

( * ) Notice: Subject to any disclaimer, the term of this patent is extended or adjusted under 35 U.S.C. 154(b) by 0 days.

(21) Appl. No.: 10/084,000

(22) Filed: Feb. 26, 2002

(51) Int. Cl.[7] ..... H01Q 1/26; H01Q 11/12

(52) U.S. Cl. ..... 343/701; 343/741; 343/866; 343/876

(58) Field of Search ..... 343/701, 741, 343/742, 866, 867, 876, 745, 749, 750; 333/103

(56) References Cited

U.S. PATENT DOCUMENTS 3,641,364 A * 2/1972 Rippel ..... 327/124
4,672,686 A * 6/1987 Raoux et al. ..... 455/123
5,365,240 A * 11/1994 Harmuth ..... 343/701
5,402,133 A 3/1995 Merenda ..... 343/701
6,229,494 B1 5/2001 Merenda ..... 343/741

* cited by examiner

*Primary Examiner*—Tan Ho
(74) *Attorney, Agent, or Firm*—Kenneth P. Robinson

(57) ABSTRACT

Radiation synthesizer systems provide efficient wideband operation with an antenna, such as a loop, which is small relative to operating wavelength. Energy dissipation is substantially reduced by cycling energy back and forth between a high-Q radiator and a storage capacitance. Systems using multi-segment loop antennas match antenna input impedance to switching circuit parameters. Control signal feeds employ fiber-optic cables and reduce conductive paths. Multi-voltage DC supply configurations use parallel conductor portions of antenna loop segments and reduce the need for separate DC supply conductors. Spurious conductive loops are thereby reduced and lightweight, flexible antenna constructions are enabled.

23 Claims, 5 Drawing Sheets

RADIATION SYNTHESIZER FEED CONFIGURATIONS

RELATED APPLICATIONS (Not Applicable)

FEDERALLY SPONSORED RESEARCH (Not Applicable)

BACKGROUND OF THE INVENTION

The present invention relates to radiating systems and, more particularly, to improved radiation synthesizer systems enabling efficient use of small high-Q antennas by active control of energy transfer back and forth between an antenna reactance and a storage reactance.

The theory and implementation of Synthesizer Radiating Systems and Methods re described in U.S. Pat. No. 5,402,133 of that title as issued to the present inventor on Mar. 28, 1995. Further aspects are described in U.S. Pat. No. 6,229,494, titled Radiation Synthesizer Systems and Methods, as issued to the present inventor on May 8, 2001. These patents ("the'133 patent" and "the '494 patent") are hereby incorporated by reference.

A basic radiation synthesizer circuit, as described in the '133 patent, which combines transfer circuits in both directions using two switches is shown in FIG. 1*a*. This circuit functions as an active loop antenna where the loop antenna L is the high Q inductive load and a capacitor C is used as the storage reactor. The FIG. 1a circuit uses two RF type switching transistors, shown as switches RC and DC, for rate and direction control, respectively. Because the devices are operated in a switch mode, efficient operation is obtained since, in theory, no instantaneous power is ever dissipated by such devices. A slower switching device, shown as power control switch PC, can be used to add energy to the circuit from the power supply as energy is radiated. The voltage and current sensor terminals VS and CS, respectively, are used to monitor and calculate the total amount of stored energy at any instant in time, while a feedback control circuit is used to maintain the total energy at a preset value through use of the power control switch PC.

In the FIG. 1*a* circuit, when the direction control switch is open, energy can be transferred from current through the inductor L to voltage across the capacitor C, as illustrated by the L to C energy transfer diagram of FIG. 1*b*. With the rate control switch closed, current flows from ground, through diode D1 and L, and back to ground through the rate control switch RC. In the absence of circuit losses, the current would continue to low indefinitely. When the rate control switch RC is opened, the inductor current, which must remain continuous, flows through diode D2 and charges up the capacitor C. The rate at which C charges up is determined by the switch open duty cycle of the switch RC. The capacitor will charge up at the maximum rate when the switch is continuously open. The charging time constant is directly proportional to the switch open duty cycle of the rate control switch RC.

When the direction control switch DC of FIG. 1*a* is closed, energy can be transferred from voltage across the capacitor to current through the inductor, as shown in the C to L energy transfer diagram of FIG. 1*c*. Diode DI is always back biased and is, therefore, out of the circuit. When the rate control switch RC is closed, the capacitor C will discharge through L, gradually building up the current through L. If the rate control switch is opened, the capacitor will maintain its voltage while the inductor current flows in a loop through diode D2. In this C to L direction transfer mode, the rate is controlled by the switch closure duty cycle of switch RC. The maximum rate of energy transfer occurs when the switch RC is continuously closed. Its operation is the inverse of that in the other direction transfer mode (L to C).

It should be noted that, in either direction, charge or discharge is exponential. Therefore, the rate of voltage or current rise is not constant for a given rate control duty cycle. In order to maintain a constant rate of charging (ramp in voltage or current), it is necessary to appropriately modulate the duty cycle as charging progresses. Duty cycle determinations and other aspects of operation and control of radiation synthesizer systems are discussed at length in the '133 patent (in which FIGS. 1*a*, 1*b* and 1*c* referred to above appear as FIGS. 8*a*, 8*b* and 8*c* ).

In theory, since the power which is not radiated is transferred back and forth rather than being dissipated, lossless operation is possible. However, as recognized in the '133 patent losses are relevant in high frequency switching operations, particularly as a result of the practical presence of ON resistance of switch devices and inherent capacitance associated with switch control terminals. While such device properties are associated with very small losses of stored energy each time a switch is closed, aggregate losses can become significant as high switching frequencies are employed. In addition, if small loop antennas are to be employed, for example, antenna impedance may be higher than basic switching circuit impedance levels, necessitating use of impedance matching circuits which may have less than optimum operating characteristics.

The basic radiation synthesizer circuit discussed above can be reduced to the simplified ideal model shown in FIG. 2. This model replaces the diodes in the basic circuit by ideal switches, and provides push-pull operation (current can flow in either direction through the loop antenna). The push-pull, or bipolar circuit, is more efficient than the single-ended circuit by a factor of 2 (3 dB). The FIG. 2 system includes four power switch devices comprising a switching circuit pursuant to the invention, a complete implementation of which is shown in FIG. 3. The FIG. 2 system includes loop antenna 12, storage capacitor 14 and power switch devices 21, 22, 23 and24, which will also be referred to as switch devices S1, S2, S3 and S4, respectively. Three possible states exist: linear charging of inductor current, linear discharging, and constant current. It is possible to synthesize any waveforn using this circuit, with waveform fidelity dependent on sampling speed.

FIG. 2 shows a basic form of radiation synthesizer system with a single switching circuit connected to the two input terminals of a standard loop antenna. Each switch may consist of several individual devices either connected in series or parallel in order to realize optimized performance at the desired radiation power level. At some frequencies of operation additional practical constraints may require consideration. As a first consideration, the device parameters may necessitate very low antenna input terminal impedance in order to realize acceptable performance. That impedance may not be compatible with a single-turn loop of appropriate size. As a second consideration, a single-turn loop may be subject to an electrical resonance when the antenna is moderately small. This resonance occurs when the distance around the loop perimeter approaches one-half wavelength at an operating frequency.

Pursuant to the '494 patent, a multi-segment loop configuration using distributed switching electronics provides a solution addressing these considerations. An embodiment in which the antenna has been broken into four loop segments and uses four switching circuits controlled by synchronous signals is described by way of example in that patent. The effective terminal impedance that is presented to each switching circuit is equal to 1/N times the total loop impedance where N is the number of loop segments. Hence, the optimum low-impedance antenna impedance level may be achieved by dividing the loop into the appropriate number of segments. The electrical resonance of this approach occurs when each segment length approaches one-half wavelength. Therefore, the resonance is increased in frequency by a factor of N over the non-segmented approach. it is possible, using this approach to obtain acceptable performance at any frequency by properly segmenting the loop.

FIG. 3 shows a synthesizer radiating system 60, as described in the '494 patent, employing a multi-segment loop radiator in the form of a single-turn loop separated into four segments 61–64. In FIG. 3, the single switching circuit of FIG. 2 is replaced by four switching circuits (i.e., four "sub-circuits") 10*a*, 10*b*, 10*c*, 10*d*, each of which is coupled to the ends of two successive ones of loop segments 61–64, as shown. Each of the sub-circuits 10*a–d* may be similar to switching circuit 10 of FIG. 2, except for the described coupling to loop segments 61–64 instead of to the ends of continuous loop 12 as in FIG. 2. The multi-segment loop radiator system 60 thus comprises a loop antenna element configured as a plurality of successive loop segments 61–64 and a like plurality of switching circuits 10*a–d* each coupled to a different pair of loop segments. Each switching circuit (i.e., sub-circuit) includes switch devices arranged for controlled activation as described above to transfer energy back and forth from the loop segments to which it is coupled to a portion of said storage capacitance (i.e., to one of capacitors 14*a–d* of FIG. 3).

Although any number of segments may be utilized pursuant to design considerations as discussed, in FIG. 3 the plurality of successive loop segments consists of four loop segments 61–64, which are employed with a like plurality of switching circuits consisting of four switching circuits 10*a–d*, each having a respective capacitor 14*a–d* coupled thereto. Thus, in FIG. 3, the basic storage capacitance comprises a plurality of capacitive devices, one coupled to each switching circuit.

In a particular implementation, the multi-segment loop radiator system as represented in FIG. 3 may be constructed as a flexible ribbon including loop segments and switching circuits physically arranged as a continuous flexible loop capable of being supported by a jacket or other article of clothing. Such an operable while wearing system may desirable include a portable receiver/transmitter and portable battery coupled to the switching circuits to comprise an individually transportable communication system. Such receiver/transmitter (e.g., as described with reference to FIG. 13 of the '133 patent) may typically be provided in miniaturized form and coupled in parallel to each of the switching circuits 10*a–d* to enable simultaneous excitation of loop segments 61–64.

Continuing work with synthesizer radiating systems has indicated the desirability of further development and improvement, including arrangements relating to aspects of signal feeds and provision of DC power to portions of a synthesizer radiating system, particularly in multi-segment antenna configurations.

Objects of the invention are, therefore, to provide new and improved synthesizer radiating systems, particularly such as enable one or more of the following advantages and capabilities:

improved control signal feed configurations;

control signal feed via fiber optic cables;

use of optical signal paths not subject to induced currents via inductive coupling;

improved DC supply configurations;

use of antenna loop segments in dual capacity to couple DC voltages;

use of multiple conductor antenna loop segments to couple a plurality of DC voltages; and avoidance of separate DC supply conductors subject to induced currents via inductive coupling.

SUMMARY OF THE INVENTION

In accordance with the invention, a synthesizer radiating system, wherein energy is transferred back and forth between an inductive antenna element and storage capacitance by controlled activation of switching circuits, utilizes a loop antenna element configured as a plurality of successive loop segments. A plurality of switch modules are each coupled to a different pair of loop segments and each switch module includes switch devices arranged for controlled activation to transfer energy back and forth between the storage capacitance and the loop segments coupled to the switch module. The system may incorporate a control signal feed including at least one optical signal path coupled to each switch module for control of activation of the switch devices. The system may also include a DC supply including a first DC coupling to a loop segment, DC couplings between successive loop segments, and DC couplings between loop segments and selected switch modules. The DC couplings are arranged to enable coupling of a DC voltage to the switch modules via the loop segments, while limiting coupling of non-DC signals.

The system may further include an optical modulator responsive to a feed signal (e.g., representative of a signal to be radiated) to provide control signals via the optical signal paths. A plurality of optical demodulators, each coupled between an optical signal path and one switch module, process control signals provided via the optical signal paths for use to control activation of the switch devices.

The system may incorporate loop segments which each include at least first and second parallel conductor portions which are DC-isolated from each other. For use with such multi-conductor loop segments, a DC supply may include (i) a first DC coupling to a first conductor portion, DC couplings between successive first conductor portions, and DC couplings between first conductor portions and selected switching circuits, and (ii) a second DC coupling to a second conductor portion, DC couplings between successive second conductor portions, and DC coupling between second conductor portions and selected switching circuits, with the DC couplings arranged to limit coupling of non-DC signals. With this construction, the DC couplings may be arranged to enable coupling of a plurality of DC voltages to each switching circuit, via the respective at least first and second parallel conductor portions, while limiting coupling of non-DC signals.

For a better understanding of the invention, together with other and further objects, reference is made to the accompanying drawings and the scope of the invention will be pointed out in the accompanying claims.

DESCRIPTION OF THE INVENTION

Figure 1A:
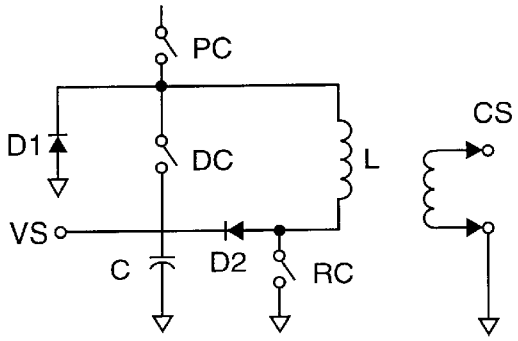
FIG. 1a PRIOR ART
FIGS. 1*a*, 1*b* and 1*c* are simplified circuit diagrams useful in describing operation of prior art synthesizer radiating systems.
Figure 1B:
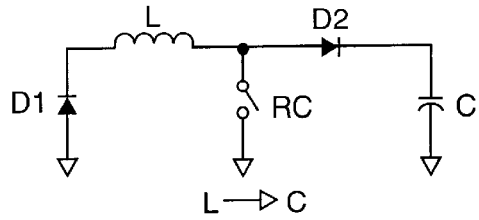
FIG. 1b PRIOR ART
Figure 1C:
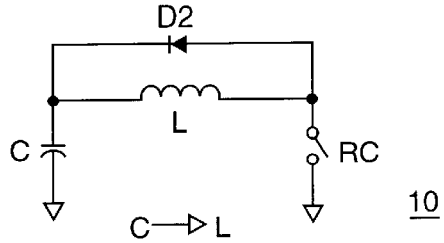
FIG. 1c PRIOR ART
Figure 2:
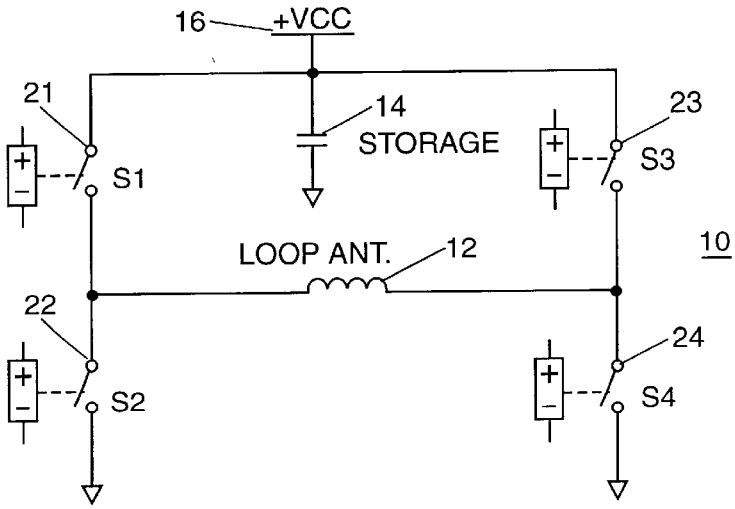
FIG. 2 PRIOR ART
FIG. 2 shows a form of prior art synthesizer radiating system.
Figure 3:
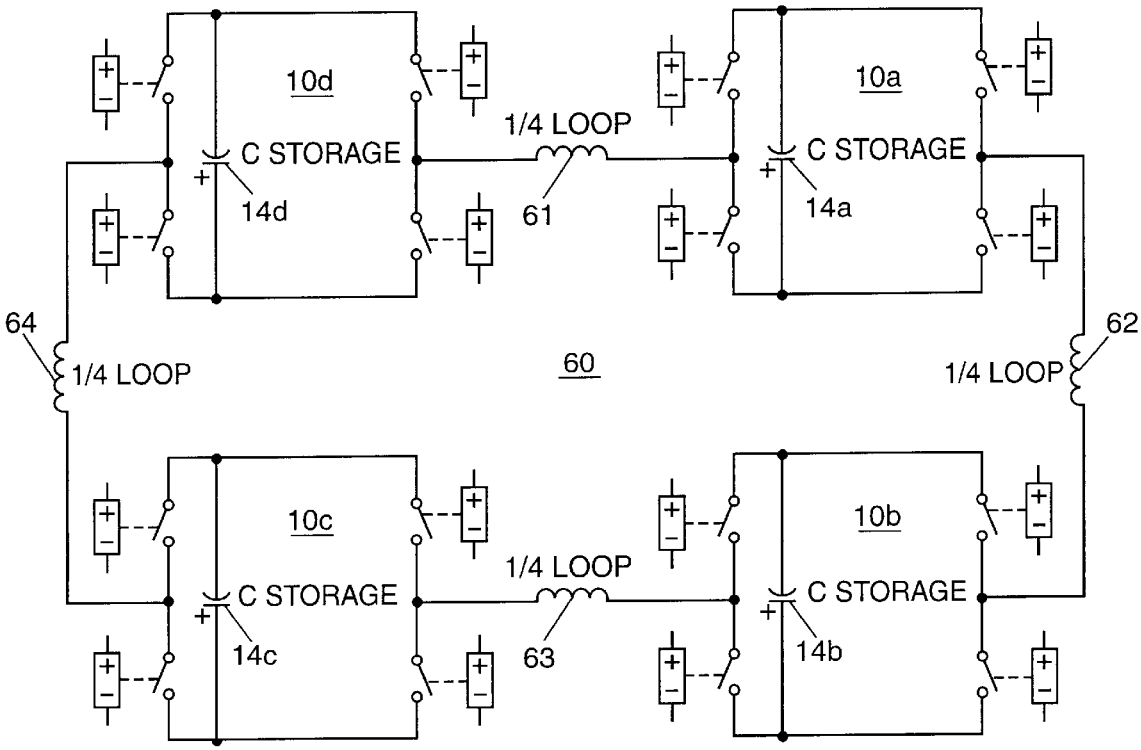
FIG. 3 PRIOR ART
FIG. 3 shows a prior art synthesizer radiating system employing a multi-segment loop radiator system.

One implementation of an improved radiation synthesizer system uses several switching circuits, with associated loop segments of a loop antenna to accomplish the radiation synthesizer function. As shown in simplified form in FIG. 4, an example of such a system 70 includes four switch modules 71, 72, 73, 74, each including a switching circuit, and a loop antenna element consisting of four loop segments (e.g., conductor sections) 75, 76, 77, 78. As shown, each switch module is coupled to a different pair of the loop segments 75, 76, 77, 78. The system is arranged to provide a radiated signal as a result of energy transfer back and forth between an inductive element and storage capacitance by controlled activation of the switching circuits, as described. For this purpose, each switch module includes switch devices (e.g., devices S1–S4 of FIG. 2) arranged for controlled activation to transfer energy back and forth from the loop segments to which it is coupled to a portion of the storage capacitance (which may be separated into four portions or sections, each coupled to one switching circuit as in FIG. 3). For a full description of this mode of system operation and detailed implementation of specific aspects thereof, attention is directed to the '133 and '494 patents.

Figure 4:
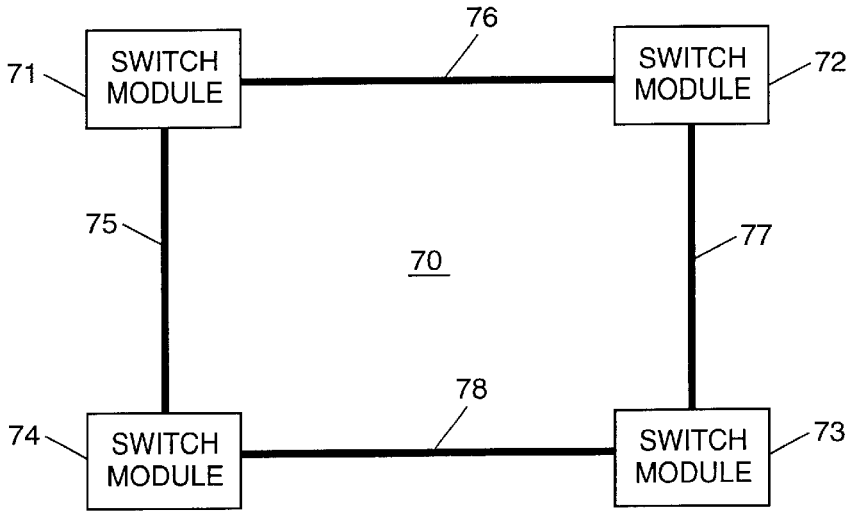
FIG. 4 shows a form of synthesizer radiating system employing multi-function switch modules in accordance with the invention.
Figure 5:
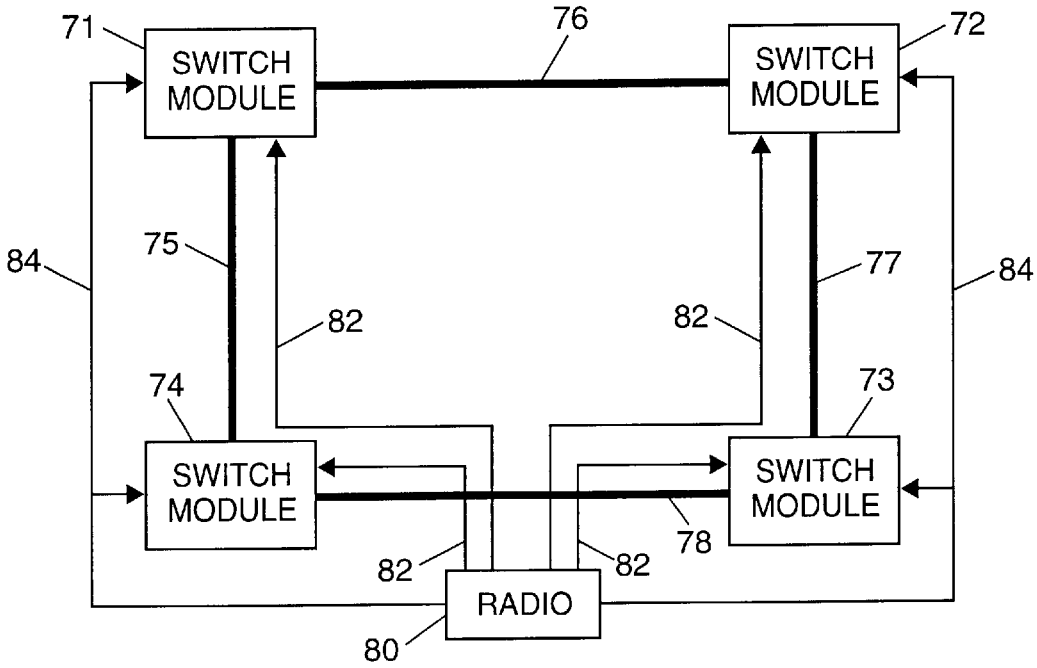
FIG. 5 illustrates conductive control and power feeds usable with the FIG. 4 system.

The switch modules 71–74 of FIG. 4 must be synchronized for the antenna (i.e., the loop antenna represented by segments 75–78) to radiate effectively. Synchronization may be accomplished by deriving all switch control signals from a common source. In a radio application, in which it is desired to radiate a signal representative of data, voice or other information, switch control signals may be derived from the desired radio transmission waveform and may be considered to be provided as an output signal of a radio. While for transmission purposes, in the past a radio would typically provide an output signal to a relatively simple prior art antenna, here such output signal can be employed in derivation of the switch control signals, as more fully described in the '133 and '494 patents. For synchronization, such switch control signals may be provided via a transmission path from the radio source to each switch module. It is desirable that the transmission paths be of equal effective length in order to maintain accurate synchronization, especially at higher frequencies of operation. In order to activate switch modules 71–74 it is also necessary to provide a DC supply including conductive paths to distribute power (e.g., via one or more DC voltages) to each switch module. A version of the FIG. 4 system with the addition of control signal and DC supply conductors is shown in simplified form in FIG. 5. Block 80, labeled "radio" is represented as the source of both switch control signals coupled via individual transmission paths 82 (shown in simplified fashion, but desirably of equal length) and DC power supplied via a bus configuration 84.

Figure 6:
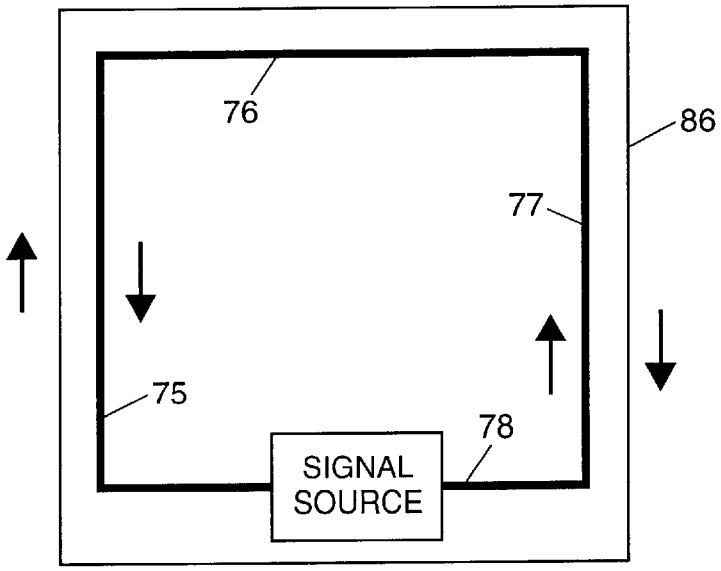
FIG. 6 is useful in describing induced current paths with reference to the FIG. 5 arrangement.

Provision of conductive lines (e.g., conductors 82 and 84 as in FIG. 5) adjacent to or in the close vicinity of the loop segments 75–78 can result in decreased operating efficiency of the system, in the form of decreased radiated signal strength. Such decrease an result from the presence of one or more conductive paths which are capable of functioning as conducting loops. For purposes of description, a single such conducting loop is represented at 86 in FIG. 6. While a single such loop as illustrated would be particularly deleterious operationally, smaller loops or other configurations or combinations of control signal transmission paths, DC supply lines, or both, can also produce undesirable effects in this regard.

Operationally, the synthesizer radiating system radiates signals as a result of currents flowing back and forth via the loop segments 75–78. The radiated signals will induce currents in loop 86 of opposite direction to the loop segment currents. In a worst case condition of a conducting loop similar to loop 86 of FIG. 6, the induced opposite direction currents could be nearly equal in magnitude to the antenna currents. The induced current in loop 86 will produce radiation in opposite phase to the desired radiation and will have the effect of tending to cancel the desired radiation. The net effect can thus be a significant suppression of the amplitude of the desired radiation, so that operating efficiency is significantly decreased.

Pursuant to the present invention, a synthesizer radiating system may include a control signal feed utilizing optical signal paths, a DC supply utilizing coupling of DC voltages via the antenna loop segments, or both. Each of these cases enables reduction of the number and extent of conductors present, other than the conductors comprising the actual loop segments of the antenna.

Figure 7:
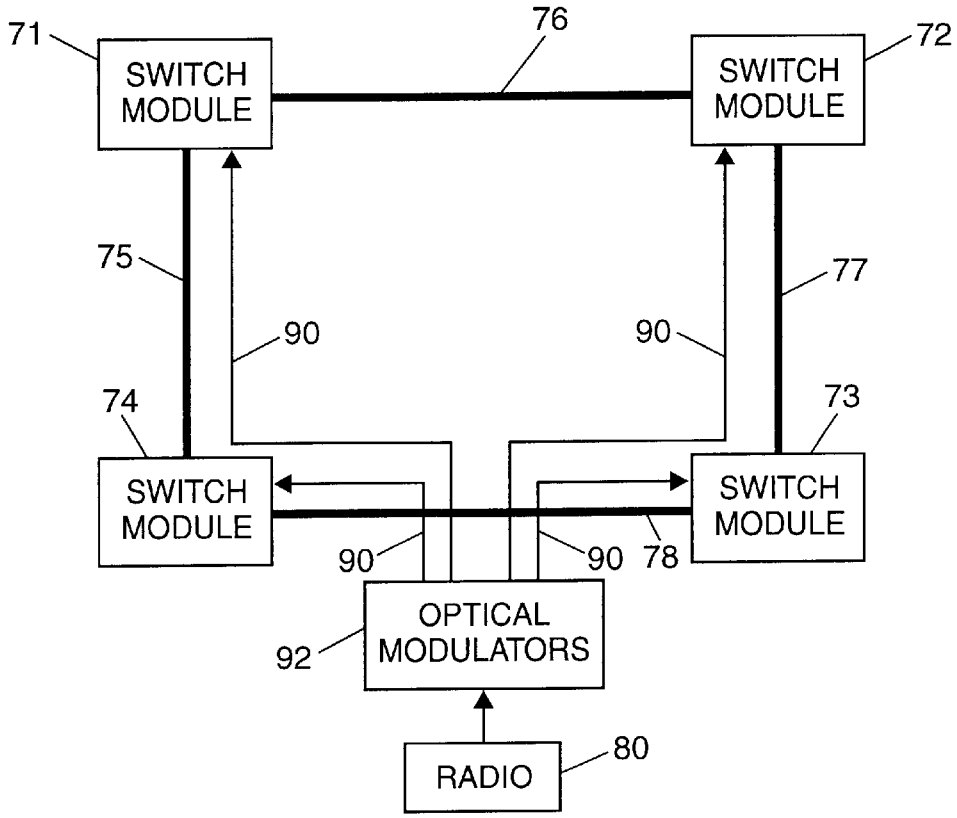
FIG. 7 illustrates a FIG. 4 type system employing optical signal paths for control signals and FIG. 7*a* illustrates inclusion of an optical demodulator in a switch module.
Figure 7A:
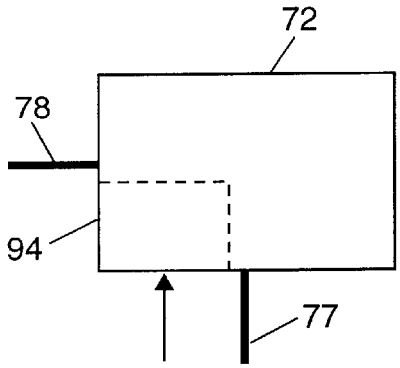

The FIG. 7 synthesizer radiating system, in addition to a loop antenna comprising loop segments 75–78 and switch modules 71–74 as discussed above, includes a control signal feed having optical signal paths 90 coupled to the switch modules 71–74 for control of activation of switch devices in the switching circuits. As shown, an optical modulator 92 receives a signal feed from radio 80 and is arranged to provide control signals via the optical signal paths 90, which may be fiber optic cables. Optical modulator 92 thus converts the desired feed signal as received (e.g., from radio 80) to control signals in optical format which are provided to each switch module via optical signal paths 90. For processing of the optical signals, each switch module includes an optical demodulator or detector arranged to convert the optical signals to electrical control signal format usable to control activation of switch devices. FIG. 7*a* illustrates typical inclusion of an optical demodulator as block 94 included in switch module 72.

With this arrangement, control signals are provided to the switch modules without requiring the presence of conductive signal transmission paths for this purpose. With the use of optical signal paths in the form of fiber optic cable formed of plastic or glass, control signals are coupled via paths which are not subject to induced currents that can degrade system performance. Optical fibers permit any convenient placement anywhere in proximity to the loop segments of the antenna element without introduction of induced currents. Fiber optic detection circuits, such as unit 94 in FIG. 7*a*, may be miniaturized using a monolithic implementation and included as a portion of a switch module integrated circuit, for example.

Fiber optic cable may be implemented in very thin 0.5 mm or 20 mil-inch configurations, for example. This cable can be coiled in a small volume within optical modulator 92, for example, to accommodate extra cable lengths as appropriate to equalize path length to each switch module. While optical signal paths 90 appear in FIG. 7 as single paths, a plurality of optical paths may be provided to carry control signals. For example, four paths may be used to carry control signals independently for each of the four switch devices of a switching circuit. Alternatively, control signals for four switch devices may be conveyed via a single optical path by sending a replica of the desired output waveform or by analog or digital encoding of four control signals. Suitable electronic circuits in the switch modules would then either derive switch commands from the desired output waveform or decode the four encode d signals to provide the switch commands.

Figure 8:
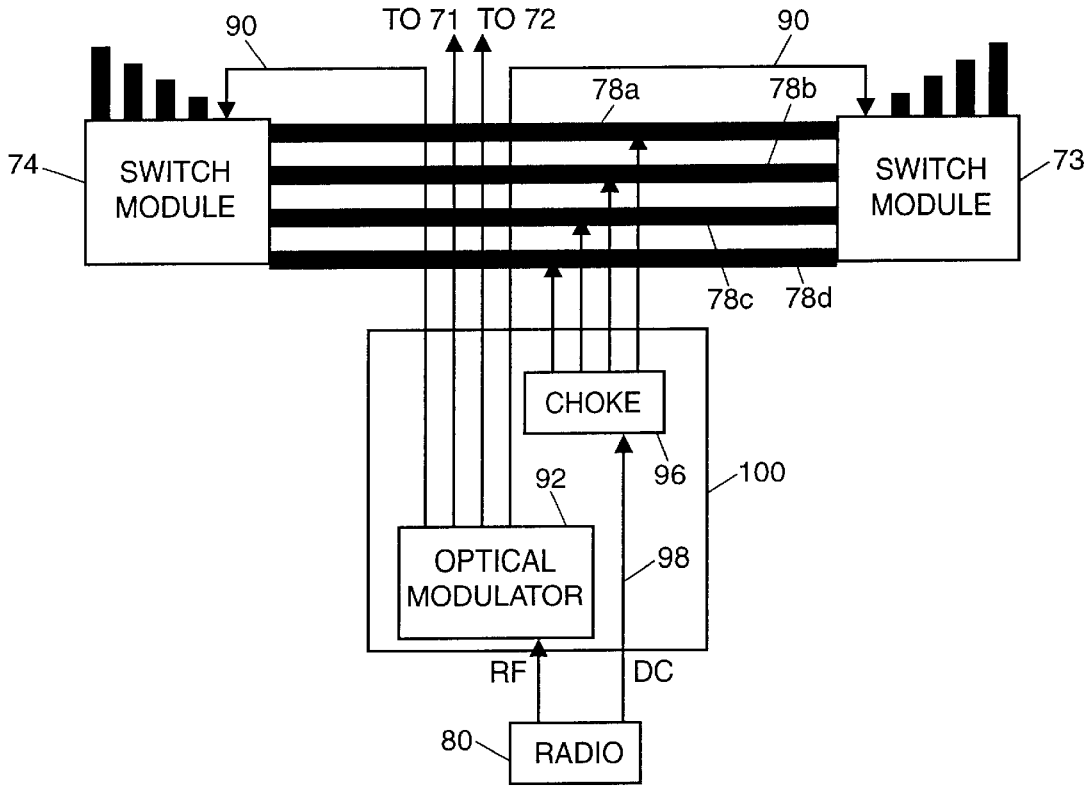
FIG. 8 illustrates a FIG. 4 type system employing multi-conductor antenna loop segments to supply multiple DC voltages to switch modules.

FIG. 8 represents the lower portion of the FIG. 7 synthesizer radiating system with the single conductor loop segment 78 of FIG. 7 replaced by a loop segment comprising parallel conductors 78*a*, 78*b*, 78*c* and 78*d*, which are DC isolated from each other. While not shown, in this configuration each of the loop segments 75, 76, 77 of FIG. 7 is also replaced by a loop segment comprising four parallel conductors. Thus, in this configuration each loop segment of the loop antenna element includes at least first and second parallel conductor portions (four parallel conductor portions in the FIG. 8 example) which may be provided in printed circuit ribbon format or other suitable form or construction.

The parallel conductor portions 78*a*, 78*b* 78*c* and 78*d* are arranged to function the same as or comparably to the single conductive portion 78 of FIG. 7 in regard to RF frequencies and signals to be radiated. Such RF performance may be enhanced by provision of low impedance RF coupling capacitively provided in the switch modules, as will be further described. With conductor portions 78*a*, 78*b*, 78*c*, 78*d* isolated at DC (e.g., "DC isolated") a different DC voltage may be applied to and carried by each conductor portion in parallel. The FIG. 8 configuration, for example, enables routing of three different DC voltages, plus provision of a common return path, along the multi-conductor loop segments. In this manner three DC voltages can be supplied to each of the switch modules 71–74 of FIG. 7 to meet operating requirements, while limiting or eliminating the need for power supply conductors in addition to the conductor configuration used for the loop antenna element. As shown in FIG. 8, a single interface module 100 for the radiating system may be configured to include the optical modulator 92 and a choke unit 96. Choke unit 96 may include any suitable circuit or configuration effective to limit passage of RF signals beyond the choke unit (e.g., from unit 96 to path 98 in FIG. 8). The four connections shown extending from choke unit 96 to respective conductor portions 78*a*, 78*b*, 78*c* and 78*d* may be utilized to couple three DC voltages, with a common return, as previously discussed. The DC voltages suitable for operation of the switch modules may be provided from radio unit 80 via a four-conductor cable 98 or may be provided in any other appropriate manner. Alternatively, a minimum number of different DC voltages may be provided as inputs to interface module 100 and additional DC supply voltages may be derived therefrom in known manner within module 100 or within each switch module 71–74.

Figure 9:
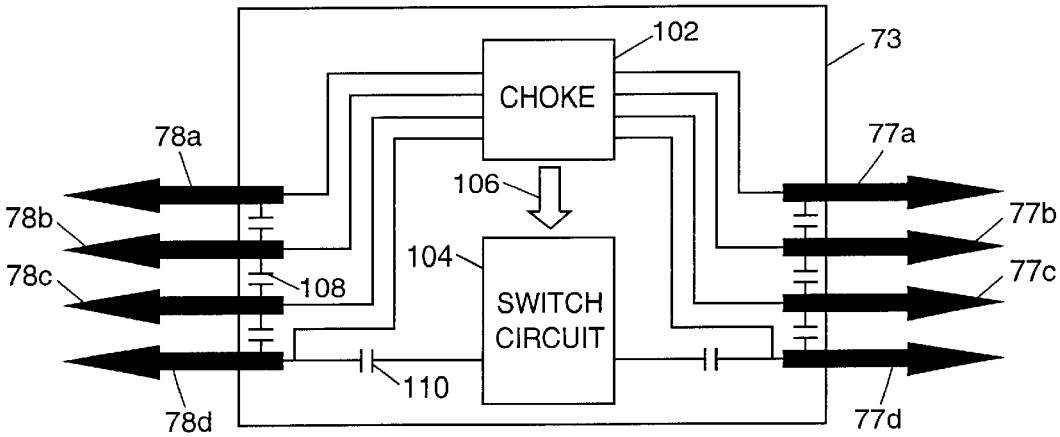
FIG. 9 illustrates aspects of a form of DC voltage coupling via multi-conductor antenna loop segments.

FIG. 9 illustrates details of a switch module (e.g., switch module 73 of FIG. 8) arranged to utilize three DC supply voltages as carried by the parallel conductor portions after the voltages are applied to the respective conductor portions 78*a*, 78*b*, 78*c*, 78*d* as discussed with reference to FIG. 8. It will be appreciated that such DC supply voltages need be applied at only one appropriate point along the sequence of loop segments in order to be supplied in the present configuration to each of the switch modules 71–74. Also, while the conductors of loop segments 77 and 78 are shown coupled in end-to-end fashion to switch module 73 in FIG. 9 and in perpendicular fashion in FIG. 7, any appropriate loop segment/switch module configuration may be employed, depending on the particular application, whether.the number of loop segments and switch modules is odd or even, etc.

As shown in FIG. 9, each of the individual conductors of loop segment 77 (i.e., conductor portions 77*a*, 77*b*, 77*c*, 77*d*) is coupled to a corresponding one of the conductors of loop segment 78 (i.e., conductor portions 78*a*, 78*b*, 78*c*, 78*d*) via choke unit 102. Pursuant to the description above, each of conductor portions 78*a*, 78*b*, 78*c* may carry a different DC supply voltage, with conductor portion 78*d* used as the common return, for example. Choke unit 102 is arranged to both couple the three voltages between the respective conductor portions of loop segments 77 and 78 and also couple the three voltages to switch circuit 104 via multi-conductor coupling 106. Choke unit 102 is also arranged to limit or prevent coupling of RF signals between successive loop segments (e.g., between conductor segments 78*a* and 77*a*) and to switch circuit 104 via coupling 106. Switch circuit 104 receives switch control signals via an optical path connection (e.g., via optical demodulator 94 of FIG. 7*a*) and controls the supply of RF energy to the loop segments for purposes of providing radiated signals in accordance with operation of the synthesizer radiating system as described in the '133and '494 patents.

As shown, the respective conductor portions (e.g., 78*a*, 78*b*, 78*c*, 78*d* ) of each loop segment are intercoupled by capacitances (e.g., capacitor 108) providing a low impedance path at the radiation signal frequencies, so that the four parallel conductor portions are maintained at the same RF voltage. As a result, for each loop segment its our parallel conductor portions behave as a single wider conductive strip at radio frequencies. Capacitive couplings are also provided (e.g., via capacitor 110) between switch circuit 104 and the parallel conductor portions of loop segments 78 and 77. With this arrangement, switch circuit 104 is RF coupled to the sets of parallel conductor portions at each side in FIG. 9, the individual conductor portions at each side are held at respective common RF voltage, and the switch circuit can control the RF voltage at each side independently. At the same time, the parallel conductor portions on each side are DC isolated from each other (e.g., 78*a*, 78*b*, 78*c* and 78*d* DC isolated from each other) but DC coupled to respective same-voltage conductor portions on a side-to-side basis (e.g., 78*a* DC coupled to 77*a*) via choke unit 102, which is DC coupled to switch circuit 104. There is thus a continuous DC path between corresponding parallel conductor portions on opposite sides of switch module 73, but such conductors are RF isolated from side-to-side of a switch module. While not shown in FIG. 9, an optical demodulator may be included in or combined with switch circuit 104 or otherwise provided in relation to switch module 73.

Any suitable form of choke or isolation device may be provided for these purposes using known techniques. For example, balun chokes may be fabricated by use of twin-lead or twisted-pair transmission line wound around a ferrite core. This approach can maintain transmission line properties, while presenting a high RF common mode impedance in series by virtue of the inductance of the winding. A DC coupling can thus be provided while providing RF isolation. While application and routing of three DC voltages has been described, any appropriate number can be accommodated by changing the number of parallel conductor portions making up each loop segment of the loop antenna element.

The arrangements described enable adverse effects of induced currents in control signal and power supply conductors to be reduced or eliminated by eliminating control signal conductors, power supply conductors, or both. In addition, by use of thin flexible fiber optic cables and avoidance of additional conductors for DC supply purposes, lightweight and flexible antenna constructions ar enabled. In particular applications control signal and DC supply feeds can be used in combination or separately with other techniques, as appropriate.

While there have been described the currently preferred embodiments of the invention, those skilled in the art will recognize that other and further modifications may be made without departing from the invention and it is intended to claim all modifications and variations as fall within the scope of the invention.

What is claimed is:

1. A synthesizer radiating system, wherein energy is transferred back and forth between an inductive antenna element and storage capacitance by controlled activation of switching circuits, comprising:

a loop antenna element configured as a plurality of successive loop segments;

a plurality of switch modules each coupled to a different pair of loop segments, each switch module including switch devices arranged for controlled activation to transfer energy back and forth between the storage capacitance and the loop segments coupled to the switch module;

a control signal feed including at least one optical signal path coupled to each said switch module for control of activation of said switch devices; and a DC supply including a first DC coupling to a loop segment, DC couplings between successive loop segments, and DC couplings between loop segments and selected switch modules, said DC couplings arranged to enable coupling of a DC voltage to the switch modules via the loop segments, while limiting coupling of non-DC signals.

2. A synthesizer radiating system as in claim 1, further comprising:

an optical modulator responsive to a feed signal to provide control signals via the optical signal paths.

3. A synthesizer radiating system as in claim 2, further comprising:

a plurality of optical demodulators, each coupled between a said optical signal path and one said switch module, to process control signals provided via said optical signal paths for use to control activation of said switch devices.

4. A synthesizer radiating system as in claim 2, wherein said optical signal paths include fiber-optic cable coupled between said optical modulator and each of said switch modules.

5. A synthesizer radiating system as in claim 2, wherein said feed signal is representative of a signal to be radiated by said system.

6. A synthesizer radiating system as in claim 1, wherein said storage capacitance comprises one of a common capacitance and a capacitance including a portion for use with each loop segment.

7. A synthesizer radiating system, wherein energy is transferred back and forth between an inductive antenna element and storage capacitance by controlled activation of switching circuits, comprising:

a loop antenna element configured as a plurality of successive loop segments;

a plurality of switch modules each coupled to a different pair of loop segments, each switch module including switch devices arranged for controlled activation to transfer energy back and forth between the storage capacitance and the loop segments coupled to the switch module; and a control signal feed including at least one optical signal path coupled to each said switch module for control of activation of said switch devices.

8. A synthesizer radiating system as in claim 7, further comprising:

an optical modulator responsive to a feed signal to provide control signals via the optical signal paths.

9. A synthesizer radiating system as in claim 8, further comprising:

a plurality of optical demodulators, each coupled between a said optical signal path and one said switch module, to process control signals provided via said optical signal paths for use to control activation of said switch devices.

10. A synthesizer radiating system as in claim 8, wherein said optical signal paths include fiber-optic cable coupled between said optical modulator and each of said switch modules.

11. A synthesizer radiating system as in claim 8, wherein said feed signal is representative of a signal to be radiated by said system.

12. A synthesizer radiating system, wherein energy is transferred back and forth between an inductive antenna element and storage capacitance by controlled activation of switching circuits, comprising:

a loop antenna element configured as a plurality of successive loop segments;

a plurality of switch modules each coupled to a different pair of loop segments, each switch module including switch devices arranged for controlled activation to transfer energy back and forth between the storage capacitance and the loop segments coupled to the switch module; and a control signal feed including an optical modulator, optical signal paths coupled to said modulator, and a plurality of optical demodulators each coupled between a said optical signal path and one said switch module.

13. A synthesizer radiating system as in claim 12, wherein said optical signal paths comprise fiber-optic cables.

14. A synthesizer radiating system as in claim 12, wherein said optical modulator is responsive to a feed signal representative of a signal to be radiated to provide control signals, via said optical signal paths, to said optical demodulators for use to control activation of said switch devices.

15. A synthesizer radiating system as in claim 12, further comprising:

a DC supply including a first DC coupling to a loop segment, DC couplings between successive loop segments, and DC couplings between loop segments and selected switch modules, said DC couplings arranged to enable coupling of a DC voltage to the switch modules via the loop segments, while limiting coupling of non-DC signals.

16. A synthesizer radiating system, wherein energy is transferred back and forth between an inductive antenna element and storage capacitance by controlled activation of switching circuits, comprising:

a loop antenna element configured as a plurality of successive loop segments;

a plurality of switch modules each coupled to a different pair of loop segments, each switch module including switch devices arranged for controlled activation to transfer energy back and forth between the storage capacitance and the loop segments coupled to the switch module; and a DC supply including a first DC coupling to a loop segment, DC couplings between successive loop segments, and DC couplings between loop segments and selected switch modules, said DC couplings arranged to enable coupling of a DC voltage to the switch modules via the loop segments, while limiting coupling of non-DC signals.

17. A synthesizer radiating system as in claim 16, wherein each said loop segment comprises a plurality of DC-isolated parallel conductor portions and said DC supply includes DC couplings arranged to enable coupling of different DC voltages via individual ones of said parallel conductor portions.

18. A synthesizer radiating system as in claim 17, wherein the parallel conductor portions of each loop segment are arranged for common excitation by signals to be radiated.

19. A synthesizer radiating system as in claim 16, wherein each said loop segment comprises a plurality of parallel conductor portions arranged for common excitation by signals to be radiated.

20. A synthesizer radiating system, wherein energy is transferred back and forth between an inductive antenna element and storage capacitance by controlled activation of switching circuits, comprising:

a loop antenna element configured as a plurality of successive loop segments; and a plurality of switch modules each coupled to a different pair of loop segments, each switch module including switch devices arranged for controlled activation to transfer energy back and forth between the storage capacitance and the loop segments coupled to the switch module;

wherein each said loop segment comprises at least first and second parallel conductor portions which are DC-isolated from each other and arranged for common excitation by signals to be radiated.

21. A synthesizer radiating system as in claim 20, further comprising:

a DC supply including (i) a first DC coupling to a said first conductor portion, DC couplings between successive first conductor portions, and DC couplings between first conductor portions and selected switching circuits, and (ii) a second DC coupling to a said second conductor portion, DC couplings between successive second conductor portions, and DC couplings between second conductor portions and selected switching circuits, said DC couplings arranged to limit coupling of non-DC signals.

22. A synthesizer radiating system as in claim 21, wherein said DC couplings are arranged to enable coupling of a plurality of DC voltages to each switching circuit, via the respective at least first and second parallel conductor portions, while limiting coupling of non-DC signals.

23. A synthesizer radiating system as in claim 21, wherein said at least first and second parallel conductor portions includes a third parallel conductor portion, said system further comprising:

a source to couple a first DC voltage between said first DC coupling and said third conductor portion, and couple a second DC voltage between said second DC coupling and said third conductor portion, to supply the first and second DC voltages to each switching circuit with the third conductor portions providing a common ground path.

* * * * *